United States Patent [19]

Klein

[11] 4,228,973

[45] Oct. 21, 1980

[54] INFANTRY PROJECTILE

[75] Inventor: Peter Klein, Putzbrunn, Fed. Rep. of Germany

[73] Assignee: Messerschmitt-Bölkow-Blohm GmbH, Munich, Fed. Rep. of Germany

[21] Appl. No.: 637,669

[22] Filed: Dec. 2, 1975

[30] Foreign Application Priority Data

Dec. 5, 1974 [DE] Fed. Rep. of Germany ..... 2457503

[51] Int. Cl.[3] ..... F42B 15/18; F42B 15/10; F42B 13/00

[52] U.S. Cl. ..... 244/3.1; 102/92.1; 244/33

[58] Field of Search ..... 244/3.3, 3.1, 3.24; 102/92.1; 137/15.1, 15.2

[56] References Cited

U.S. PATENT DOCUMENTS

| | | | |
|---|---|---|---|
| 2,922,365 | 1/1960 | Fredette et al. | 244/3.24 |
| 3,869,101 | 3/1975 | Schnabele et al. | 244/3.1 |

FOREIGN PATENT DOCUMENTS

| | | | |
|---|---|---|---|
| 19957 | of 1903 | United Kingdom | 244/3.1 |

*Primary Examiner*—Harold J. Tudor
*Attorney, Agent, or Firm*—Toren, McGeady and Stanger

[57] ABSTRACT

An infantry projectile includes an elongated projectile body having a cylindrical or frusto-conical surface concentrically arranged about its longitudinal axis. The projectile body has a leading end and a trailing end each extending transversely of the longitudinal axis. The leading end is disposed at an oblique angle to the longitudinal axis for affording a trimming action on the projectile when it is in flight. A flow control projection is provided on the surface of the projectile body between its ends so that the aerodynamic center of the projectile is located below its center of gravity when the flow control projection is located on the lower surface of the projectile body and in a vertical plane extending through the longitudinal axis of the body.

10 Claims, 2 Drawing Figures

INFANTRY PROJECTILE

SUMMARY OF THE INVENTION

The present invention is directed to an infantry projectile for use against ground targets and the projectile consists of a projectile body which is symmetrical about its longitudinal axis. For providing an aerodynamically stable flight path or trajectory, the projectile body has a cylindrically or frusto-conically shaped hull disposed concentrically about the longitudinal axis of the body. Further, a trimming means is formed integrally with the forward or leading end of the projectile body.

A similar infantry projectile has been disclosed in German Offenlegungsschrift 2 222 785, U.S. Pat. No. 3,869,101 (owned by the same assignee). In this projectile the trimming means is in the form of an obliquely disposed forward or leading end on the hull of the projectile body. When the angle (trimming-angle) between the obliquely disposed leading end and the longitudinal axis of the projectile is correspondingly dimensioned, after the projectile has been fired from a launching device, it will assume a trajectory over its entire flight path which coincides very closely with the firing direction. Accordingly, the aiming or sighting of the launching device is considerably facilitated, since with an approximately straight line trajectory of the projectile, only a single sighting position is required, even if the targets are at different distances. An estimation of the distance to the target with subsequent sight-adjustment, as is necessary in the firing of other prior art projectiles, is no longer necessary.

Due to the symmetry of the projectile body about its longitudinal axis, no rolling moments occur during the flight and transverse moments are generally negated or decreased by the aerodynamic stability of the projectile, a fact which has been confirmed in numerous shooting tests. Only in the presence of a very strong side wind is it possible that the projectile may be laterally displaced.

The primary object of the present invention is to modify the prior art projectile body in such a manner that its sensitivity to displacement due to a side wind is strongly reduced.

In accordance with the present invention, the problem of overcoming sensitivity to side winds, is solved by providing a flow control body on the surface of the hull so that it is located on the lower side of the hull in a symmetry plane of the projectile which extends vertically through the longitudinal axis so that the aerodynamic center of the projectile is located below its center of gravity. The symmetry plane is determined by the trimming means and, as mentioned above, passes through the longitudinal axis of the projectile.

In the normal flight path of the projectile, with its longitudinal axis pointing slightly in the upper direction, the vectors of the forces of air and gravity are situated in a common plane, that is in the above-mentioned symmetry plane of the projectile which includes its longitudinal axis. The vectors are quantitatively of equal value, however, they are directed in opposite directions. This means that the forces acting on the projectile cancel each other out in the vertical symmetry plane and the projectile will move due to this arrangement along an average straight line trajectory or flight path which is determined by the aiming or shooting direction.

If, during flight of the projectile, side wind squalls should occur, then the forces of the side wind act on the aerodynamic center which is situated below the center of gravity of the projectile. As a result, the total vector of the air forces is displaced out of the symmetry plane of the projectile into the direction of the side wind so that the action line of the vector of the air forces no longer passes through the center of gravity of the projectile and the projectile, due to the presence of the flow-control body, is subjected to a nonsymmetrical flow action. Therefore, a rolling moment develops which, with the indicated position of the aerodynamic center located below the center of gravity, is directed in such a manner that the projectile is turned about its longitudinal axis. With such movement the flow direction of the trimming means changes so that the projectile turns about its vertical axis into the side wind and thus at least partially compensates for the action of the side wind. Accordingly, the projectile oscillates in this new flow direction with a frequency which is determined by the stability and speed of the projectile and the form or shape of the flow control body so that it is subject to displacement by the trimming means in an alternating manner. The form and size of the flow control body can be chosen in such a manner that the integral of the angular changes during oscillation of the projectile, considered as a whole, occur in one direction so that during the entire flight the transverse wind forces are approximately compensated.

The flow control body may be in the form of a hemisphere. The hemisphere is particularly suitable because it can be manufactured very exactly and precisely so that nonsymmetrical phenomena due to construction of the projectile are avoided. Such nonsymmetrical characteristics could produce rolling moments during normal flight. However, a keel-like flow control body would also be suitable and could be produced without difficulty.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described preferred embodiments of the invention.

DETAILED DESCRIPTION OF THE INVENTION

Figure 1:
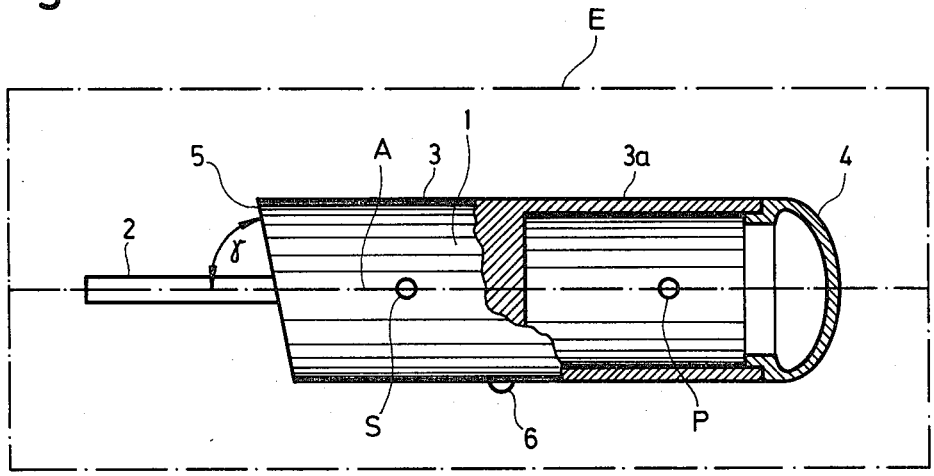
FIG. 1 is a side view, partly in section, of an infantry projectile embodying the present invention.

In FIG. 1 an infantry projectile 1 is illustrated for use against ground targets. The projectile 1 consists of a projectile body which is symmetrical with respect to its longitudinal axis A. The projectile body includes a spindle-like projection 2 extending outwardly along the longitudinal axis A from a hull 3. Spindle-like projection 2 extends from the leading end of the hull 3 and its trailing end has a stern or tail 4 with a convexly shaped outer surface. At its leading end, the hull 3 has a trimming surface 5 formed integrally with the projectile body and disposed at an oblique angle to the longitudinal axis A which angle $\gamma$ deviates only slightly from 90°.

The surface of the hull 3 is concentric to the longitudinal axis A to provide aerodynamic stability for the projectile and, as shown in FIG. 1, the concentric surface is formed as a cylindrical surface. However, the surface of the hull could also be frusto-conically shaped.

Figure 2:
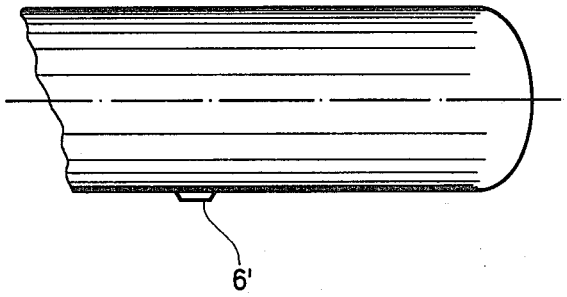
FIG. 2 is a partial side view of an infantry projectile, as shown in FIG. 1, incorporating a second embodiment of the invention.

As viewed in FIG. 1, the lower surface or under side of the projectile hull 3 is provided with a hemispherically shaped flow-controlled body 6. An alternative keel-shaped flow-control body 6' is shown in FIG. 2. By the arrangement of the flow-control body 6, 6' the aerodynamic center or center of pressure P for the projectile is situated below the center of gravity S, the center of gravity is located approximately on the longitudinal axis A of the projectile. During normal projectile flight, the center of gravity of S and the aerodynamic center P are situated in the symmetry plane E of the projectile which coincides with a vertical plane which extends through the longitudinal axis and corresponds to the plane of FIG. 1. Due to this arrangement, aerodynamic forces act on the trimming surface 5 and adjust the projectile relative to its flight path. If the trimming angle $\gamma$ is suitably chosen, then the adjustment is such that the forces which act at the center of gravity S and at the aerodynamic center P are equal, however, they act in opposite directions and the projectile body in flight moves along an elongated straight trajectory.

If a side wind acts on the projectile, the total vector of the air forces no longer passes through the symmetry plane E which contains the center of gravity S. As a result, the projectile turns about its longitudinal axis with the flow direction on the trimming means or surface 5 being changed. Due to this movement, the projectile turns about its vertical axis into the side wind until the flow direction is again symmetrical. Since no control circuit is provided, the projectile oscillates in this new position with a frequency which is determined by its stability and the shape of the flow body. The oscillating action can be dampened by the configuration of the flow control body so that during the very short flying time of the projectile, any side wind forces are approximately compensated.

I claim:

1. An infantry projectile for use against ground targets comprising an elongated projectile body having a longitudinal axis and said body being symmetrical about its longitudinal axis, said projectile body having a leading end and a trailing end each extending transversely of the longitudinal axis, the surface of said projectile body between the leading and trailing ends thereof in a plane extending perpendicularly of the longitudinal axis is concentric to the longitudinal axis, trimming means provided on the leading end of said projectile body, wherein the improvement comprises that said projectile body has a single flow-control projection extending outwardly from its concentric surface at a location intermediate the leading and trailing ends of the projectile body, said projection is arranged so that in a vertical plane of symmetry through the longitudinal axis of said projectile body with the vertical plane of symmetry determined by said trimming means said projection is located on the lower side of said projectile and the aerodynamic center of the projectile is located below the center of gravity of said projectile.

2. An infantry projectile, as set forth in claim 1, wherein in the vertical plane of symmetry through the longitudinal axis the center of gravity of said projectile is located approximately on the longitudinal axis.

3. An infantry projectile, as set forth in claim 1, wherein said flow-control projection is hemispherically shaped.

4. An infantry projectile, as set forth in claim 1, wherein said flow-control projection is keel-shaped.

5. An infantry projectile, as set forth in claim 1, wherein said trimming means comprises that the leading end of said projectile body is disposed at an oblique angle to the longitudinal axis of said projectile body.

6. An infantry projectile, as set forth in claim 5, wherein the oblique angle of the leading end of said projectile body deviates only slightly from a right angle to said longitudinal axis.

7. An infantry projectile, as set forth in claim 1, wherein said projectile body between its leading and trailing ends is cylindrically shaped.

8. An infantry projectile, as set forth in claim 1, wherein said projectile body between its leading and trailing ends of frusto-conically shaped.

9. An infantry projectile, as set forth in claim 1, wherein a spindle-like member projects longitudinally axially forwardly of the leading end of said projectile body.

10. An infantry projectile, as set forth in claim 1, wherein the outer surface of the trailing end of said projectile body is convexly shaped.

* * * * *